United States Patent [19]

Yasui

[11] Patent Number: 4,807,603

[45] Date of Patent: Feb. 28, 1989

[54] MASSAGING DEVICE HAVING CYLINDRICAL BODY WITH AT LEAST ONE GROOVE

[76] Inventor: Shinjiro Yasui, 37, Aza Higashioka, Wassamucho, Kamikawa-gun, Hokkaido, Japan

[21] Appl. No.: 51,378

[22] Filed: May 19, 1987

[30] Foreign Application Priority Data

Jun. 9, 1986 [JP] Japan ..... 61-88378

[51] Int. Cl.[4] ..... A61H 15/00

[52] U.S. Cl. ..... 128/57; 128/67

[58] Field of Search ..... 128/67, 57

[56] References Cited

U.S. PATENT DOCUMENTS

| | | | |
|---|---|---|---|
| D. 253,373 | 11/1979 | Celeste | 128/57 |
| D. 256,503 | 8/1980 | Moustakas | 128/57 |
| 1,573,652 | 2/1926 | Snyder | 128/57 |
| 1,722,866 | 7/1929 | Snyder | 128/57 |
| 1,850,862 | 3/1932 | Boyd | 128/57 |
| 2,104,927 | 1/1938 | Hassmann | 128/57 |
| 2,466,470 | 4/1949 | Norris | 128/57 |
| 2,767,707 | 10/1956 | Toivonen | 128/57 |
| 3,037,520 | 6/1962 | Dougherty | 128/57 |
| 3,662,748 | 5/1972 | Thorman | 128/57 |
| 3,705,579 | 12/1972 | Morini et al. | 128/57 |
| 4,136,867 | 1/1979 | Wilkin | 128/57 |

FOREIGN PATENT DOCUMENTS

| | | | |
|---|---|---|---|
| 2323851 | 11/1974 | Fed. Rep. of Germany | 128/57 |
| 136849 | 8/1952 | Finland | 128/57 |
| 399403 | 10/1942 | Italy | 128/57 |

*Primary Examiner*—Edgar S. Burr
*Assistant Examiner*—Tonya Lamb
*Attorney, Agent, or Firm*—Wenderoth, Lind & Ponack

[57] ABSTRACT

A massaging device consists of a body having a circular cross section formed from relatively rigid material, the body having at least one annular groove formed around its outer periphery.

14 Claims, 5 Drawing Sheets

MASSAGING DEVICE HAVING CYLINDRICAL BODY WITH AT LEAST ONE GROOVE

BACKGROUND OF THE INVENTION

The present invention relates to a massaging device and, more particularly, to a massaging device which is designed so that a user may place an affected part of his/her body on the device or press the device against such part in order to massage away stiffness or dull pain in the affected part.

A variety of structures have heretofore been employed as a type of massaging device which is pressed against an affected part of a user's body to relieve stiffness or dull pain by way of massage. Examples of conventional structures of this type of massaging device include one in which a plurality of projections are two-dimensionally arranged on the body of the device so that a user may place an affected part of his/her body on the projections and another in which a plurality of spherical members are tied in a row with a string and a user may press the spherical members against an affected part of his/her body by holding the two ends of the string.

These conventional massaging devices suffer, however, from problems in that their complicated configurations involve relatively high production costs and in that they provide unsatisfactory massaging effects.

SUMMARY OF THE INVENTION

The present invention pertains to a massaging device and, more particularly, to a massaging device which is designed so that a user may place a part of his/her body on the device or press the device against the part to relieve stiffness or dull pain or to reduce superfluous flesh etc. by massage.

It is a primary object of the present invention to provide a massaging device which has a simplified configuration, a reduced production cost and which exhibits excellent massaging effectiveness.

One of the features of the massaging device according to the present invention resides in that the device has a body with a circular cross section which is formed from a relatively rigid material and at least one annular groove is formed around the outer periphery of the body.

Another feature of the massaging device according to the present invention resides in that annular grooves are formed around the outer periphery of the body at approximately its central portion and at opposite ends, respectively.

Still another feature of the massaging device according to the present invention resides in that annular grooves are formed around the outer periphery of the body at its approximately central portion and at one end, respectively.

DETAILED DESCRIPTION OF PREFERRED EMBODIMENTS

Figure 1:
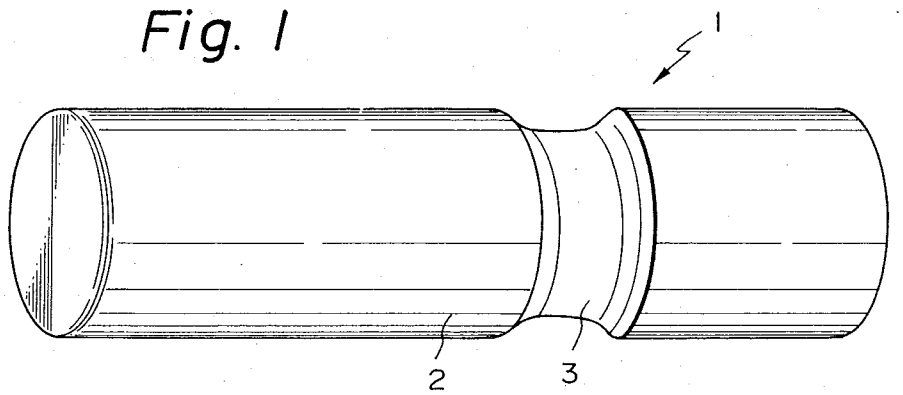
FIG. 1 is a perspective view of one embodiment of the massaging device according to the present invention.
Figure 2:
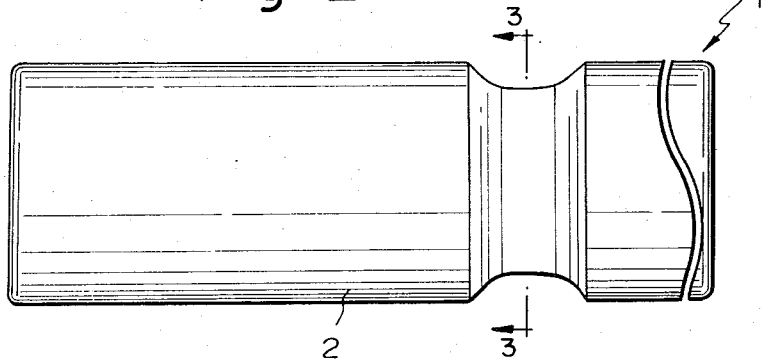
FIG. 2 is a longitudinal view of the massaging device shown in FIG. 1 with a portion thereof omitted.
Figure 3:
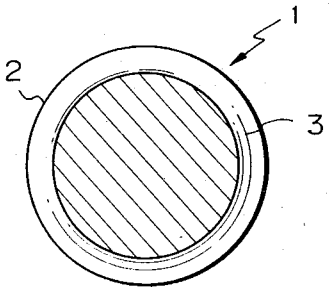
FIG. 3 is a transverse sectional view taken along the line 3—3 in FIG. 2.

Referring first to FIGS. 1 to 3, one embodiment of the massaging device according to the present invention is shown. The massaging device 1 in accordance with this embodiment has a solid cylindrical body 2 formed from a relatively rigid material such as wood, rigid paper, a synthetic resin or a metal. An annular groove 3 is formed around the outer periphery of the body 2 at approximately the central portion thereof. The groove 3 has an arcuate cross-sectional configuration.

Figure 4:
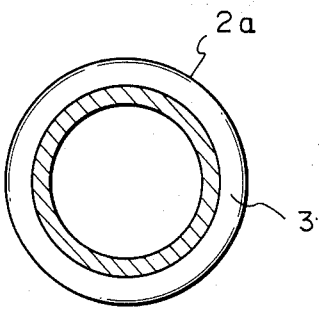
FIG. 4 shows a modification of the massaging device shown in FIG. 1 as taken in the same direction as line 3—3 in FIG. 2.
Figure 5:
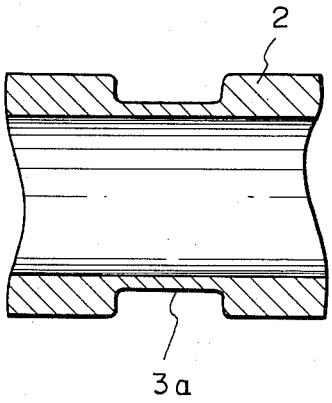
FIGS. 5 and 6 are fragmentary longitudinal sectional views of the massaging device, respectively showing modifications of the annular groove.
Figure 6:
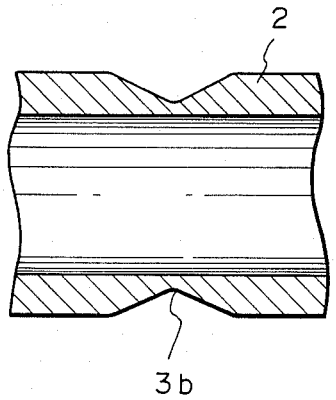

Although the body 2 in this embodiment is solid as shown in FIG. 3, it may be made hollow such as body 2*a* shown in FIG. 4. By making the body hollow, the weight of the massaging device can be reduced. The circular cross section of the groove shown in FIG. 2 is not necessarily exclusive, and the cross-sectional configuration of the groove may be of any desired shape, for example, a substantially square configuration as denoted by the reference numeral 3*a* in FIG. 5 or a V-shaped configuration as denoted by the numeral 3*b* in FIG. 6.

The following is a description of examples in which the above-described massaging device 1 is actually used.

Figure 7:
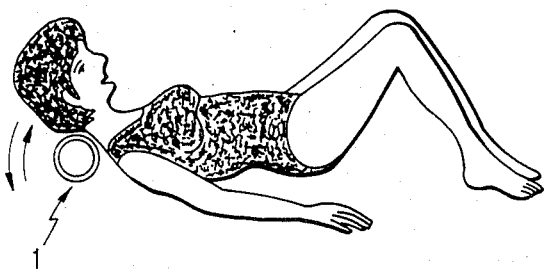
FIGS. 7 to 12 respectively show examples in which the massaging device shown in FIGS. 1 to 3 is actually used.

(1) To relieve stiffness or the like in the back of the head or of the scruff of the neck:

As shown in FIG. 7, the user lies on her back using the massaging device 1 as a pillow, moves her neck back and forth and then turns it to the right and to the left.

Figure 8:
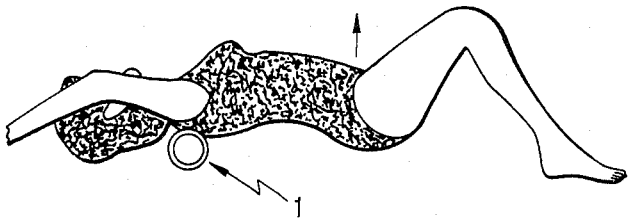
Figure 9:
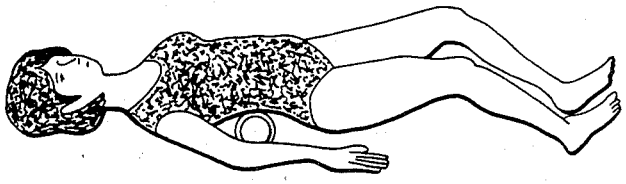

(2) To relieve stiffness in the back or waist or to reduce superfluous flesh thereon As shown in FIGS. 8 and 9, the user lies on her back with the massaging device 1 placed under her body in such a manner that her back or waist is pressed against the massaging device 1 (with her backbone positioned in the groove 3) and then rolls the massaging device 1, moving her body on the rolling device 1 while doing so.

(3) To relieve stiffness in the thighs or to reduce superfluous flesh thereon

Figure 10:
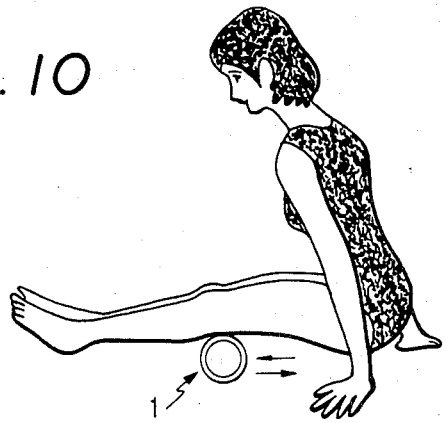

As shown in FIG. 10, the user places her thigh on the massaging device 1, presses the former against the latter by raising and supporting her body with her arms, and then moves her thigh back and forth on the rolling massaging device 1.

(4) To use the massaging device 1 for the arms or legs

Figure 11:
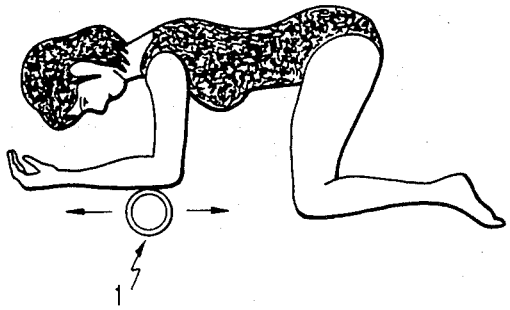
Figure 12:
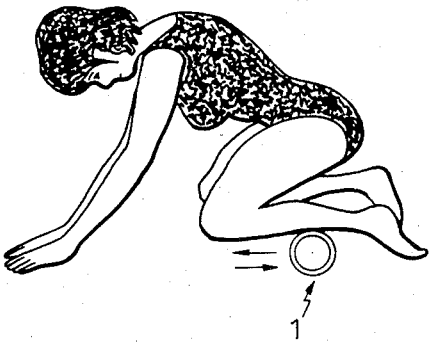

As shown in FIG. 11, the user presses her arms against the massaging device 1 in such a manner as to apply the weight of her body to the device 1 and moves her arms back and forth on the rolling massaging device 1, or as shown in FIG. 12, the user places her legs on the massaging device 1 and puts her weight thereon and then moves her body back and forth on the rolling device 1.

(5) Furthermore, as occasion demands, the user may place a desired part of her body on the massaging device 1 and put the weight of her body thereon or force said part against the device 1, rolling the device 1 while doing so.

(6) If the user massages her whole body by combining together the procedures (1) to (5) as desired, she can exercise the whole body, which provides even more advantageous effects.

In this way, any desired part of the user's body may be subjected to a natural force applied by gravity or to a pressing force, so that it is possible to obtain a remarkable effect similar to that enjoyed in the case of finger-pressure therapy.

Figure 13:
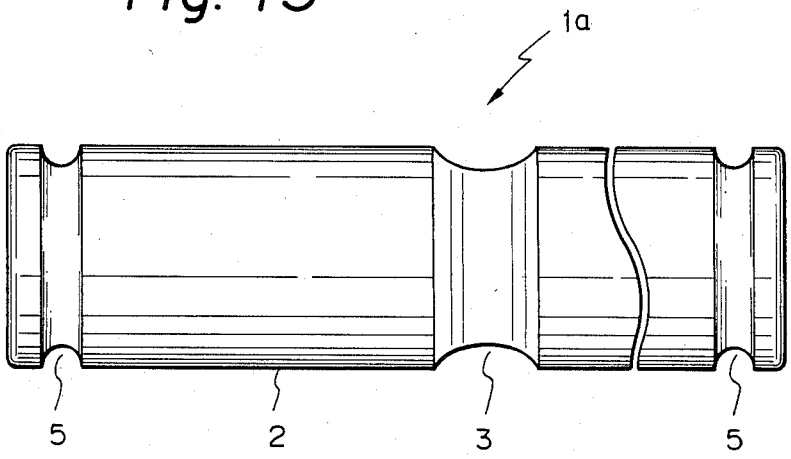
FIG. 13 is a plan view of another embodiment of the massaging device according to the present invention with a portion thereof omitted.

Referring next to FIG. 13, a massaging device 1a in accordance with another embodiment of the present invention is shown. The massaging device 1*a* in this embodiment has annular grooves 5 formed around the outer periphery of the body 2 at opposite ends thereof, respectively. The groove 5 may be formed at one end only. The width of the grooves 5 is smaller than that of the groove 3.

Figure 14:
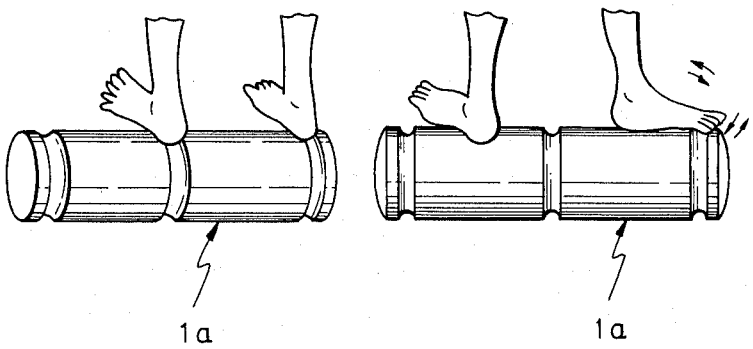
FIG. 14 shows two examples in which the massaging device shown in FIG. 13 is actually used.

When the user holds the massaging device 1*a* with her hands, the grooves 5 allow her fingers to fit therein so that she can hold the device 1*a* even more firmly. Furthermore, as shown in FIG. 14, a part of the user's body, such as the toe, may be fitted into the groove 5 during the use of the massaging device 1*a*.

The massaging device 1*a* in accordance with this embodiment may, of course, be used in the same way as in the procedures (1) to (6) described above.

The present invention has the following advantages over conventional massaging devices.

(a) The present invention provides the same effect as does finger-pressure therapy on the user's body, so that stiffness or pain can be relieved.

(b) Continuous massage of the whole body with the massaging device makes it possible to reduce surplus fat and flesh and the user's weight can thus be reduced without dieting.

(c) Continuous use of the massaging device by an elderly person makes it possible to prevent weakening of the legs and loins, thereby countering the aging process.

(d) Massage of the whole body as described in procedure (6) allows the user to enjoy an exercising of the whole body without any great effort, and it is thus possible to stimulate muscles, nerves and the like which are not frequently used in daily life, thereby improving blood circulation.

What is claimed is:

1. A massage device for massaging an affected part of a user's body when said device is disposed on a floor and the affected part is pressed atop the device and the device is rolled along the floor, said massage device consisting of a substantially rigid body, said rigid body having a smooth cylindrical outer peripheral surface extending substantially over the entire length thereof for supporting the affected part and along which the device is rollable along the floor to massage the affected part, and an annular groove extending in said rigid body and around the outer periphery of said body at a location proximate the longitudinal center thereof.

2. A massaging device as claimed in claim 1, wherein said rigid body is solid.

3. A massaging device as claimed in claim 1, wherein said rigid body is hollow.

4. A massaging device as claimed in any one of claims 1 to 3, wherein said annular groove has a substantially arcuate cross-sectional configuration.

5. A massaging device as claimed in any one claims 1 to 3, wherein said annular groove has a substantially square cross-sectional configuration.

6. A massaging device as claimed in any one of claims 1 to 3, wherein said annular groove has a substantially V-shaped cross-sectional configuration.

7. A massaging device as claimed in any one of claims 1 to 3, and wherein said body further comprises a groove extending around the outer periphery thereof at one of opposite ends of said body.

8. A massaging device according to claim 18, and wherein said body further comprises a groove extending around the outer periphery thereof at one of opposite ends of said body.

9. A massaging device according to claim 5, and wherein said body further comprises a groove extending around the outer periphery thereof at one of opposite ends of said body.

10. A massaging device according to claim 6, and wherein said body further comprises a groove extending around the outer periphery thereof at one of opposite ends of said body.

11. A massaging device as claimed in any one of claims 1 to 3, and wherein said body further comprises two grooves each of which extends around the outer periphery thereof at a respective one of opposite ends of said body.

12. A massaging device according to claim 4, and wherein said body further comprises two grooves each of which extends around the outer periphery thereof at a respective one of opposite ends of said body.

13. A massaging device according to claim 5, and wherein said body further comprises two grooves each of which extends around the outer periphery thereof at a respective one of opposite ends of said body.

14. A massaging device according to claim 6, and wherein said body further comprises two grooves each of which extends around the outer periphery thereof at a respective one of opposite ends of said body.

* * * * *